United States Patent [19]

Housman

[11] 4,100,962

[45] Jul. 18, 1978

[54] CASTING DIE

[75] Inventor: Robert B. Housman, Plainville, Mass.

[73] Assignee: James H. Housman, No. Attleboro, Mass.

[21] Appl. No.: 773,062

[22] Filed: Feb. 28, 1977

[51] Int. Cl.[2] ..... B22D 11/04

[52] U.S. Cl. ..... 164/435; 164/137; 164/341; 249/166; 403/30; 425/451.9

[58] Field of Search ..... 403/28, 29, 30; 425/451.9; 249/82, 165, 166, 135, 167; 164/137, 303, 339, 341, 342, 273, 418, 435, 82

[56] References Cited

U.S. PATENT DOCUMENTS

| | | | |
|---|---|---|---|
| 1,567,605 | 12/1925 | Lee | 249/82 |
| 1,584,954 | 5/1926 | Lee et al. | 249/135 X |
| 2,912,730 | 11/1959 | Bauer | 249/165 |
| 3,125,786 | 3/1964 | Savage | 164/435 |
| 3,581,804 | 6/1971 | Woltering | 164/137 |

FOREIGN PATENT DOCUMENTS

| | | | |
|---|---|---|---|
| 962,259 | 7/1964 | United Kingdom | 164/435 |

*Primary Examiner*—Francis S. Husar
*Assistant Examiner*—Mark Rosenbaum
*Attorney, Agent, or Firm*—Salter & Michaelson

[57] ABSTRACT

A casting die having separate die segments that cooperate to form an internal die cavity for receiving molten metal at the top thereof for subsequent solidification and removal therefrom in continuous strip or bar form. Novel retaining means in the form of cooperating bolt-/bushing sets are provided for maintaining the relative positioning of the segments, the bolts having a lower coefficient of expansion than that of the bushings, so that upon heating of the die, the relatively greater expansion of the bushings will serve to place a continuing force upon the segments through bolt tensioning so as to maintain the die segments in face-to-face relationship and to eliminate possible flashing of metal therebetween.

13 Claims, 5 Drawing Figures

CASTING DIE

BACKGROUND OF THE INVENTION

This invention relates to casting dies formed of high temperature resistant, low coefficient of heat expansion materials such as graphite, and in particular relates to an improved two-piece die construction. Such dies are used in conjunction with casting devices which direct molten metal especially previous metals such as gold and silver into an entrance cavity as provided in such dies. The opposite or exit end of the die is cooled, as by contact with circulating water, so that the molten metal entering the cavity solidifies therein and may be continuously withdrawn from the exit end in the form of strip or bar stock. Since graphite is resistant to high temperatures, has a low coefficient of heat expansion and is relatively inexpensive, it is commonly used in the construction of such dies.

The prior known graphite die has generally been formed of a one piece construction and includes a longitudinally oriented internal die cavity most often formed by time-consuming boring operations. These operations not only add to the expense of such dies, but further necessarily result in cross-sectional die cavity configurations which are rounded at the corners thereof. Such rounded shape is imparted to the strip or bar stock produced by such die and upon subsequent rolling and other forming operations has been found to contribute to edge cracking.

It has been attempted on numerous prior occasions to produce segmented or two-piece die constructions in which the die cavity or slot was machined as by inexpensive milling procedures in one or both of the die segments, which in the use thereof are held in face-to-face relationship to form the overall die construction. Dies so constructed, although utilized, generally involve either overly complex methods to hold the segments together during use, or are subject to separation during use. If the segments separate, the molten metal confined within the forming cavity may flow, i.e., flash, into such separation and after solidification form a fin which will hang up in the die and force a shutdown of the casting operation. In this regard it should be pointed out that the casting operation depends on the continual movement of metal in fluid form into the cavity and subsequent withdrawal thereof in solid form from the bottom thereof and any extensions from the solid metal column would prevent this.

One procedure utilized to hold segmented die portions together has been glueing, wherein the die segments are held under high pressure in face-to-face relationship during the curing of the adhesive. Such procedure is, as above indicated, not only expensive but has been found to lead to erosion of the adhesive interface during the casting procedure, which as with the separation of the die segments themselves is apt to form an opening into which molten metal may flow, subsequently solidifying and thus halting the casting operation. It would be accordingly desirable to form dies of the type under consideration in two parts without the above described drawbacks since such would enable not only simplified cavity machining techniques, but would also enable the formation of cavities having square cross-sectional configurations, which configuration in the resultant metal stock would enable it to be more easily reformed into other forms, i.e., sheets, rods etc.

SUMMARY OF THE INVENTION

Accordingly a primary object of the present invention is the formation of a two-piece casting die held together during use without the necessity of an adhesive interface.

A further object of the present invention is the formation of a two-piece die construction including novel means for maintaining the die segments thereof in face-to-face condition during use, which means includes portions thereof which differentially expand upon heating so that a progressively greater amount of force is applied to the die segments to assure their face-to-face maintenance during use.

A still further object of the present invention is the provision of a graphite die construction wherein an internal die cavity of rectangular cross-sectional configuration is formed by the cooperating internal faces of opposed die segments, the configuration of such die cavity being maintained without separation during use thereof.

A still further object of the present invention is the provision of a segmented graphite casting die which is easily assembleable and is of generally low cost construction.

These and other objects of the present invention are accomplished by the provision of a two-piece casting die comprising separate upper and lower opposed die segments formed of a high temperature resistant, low coefficient of heat expansion material such as graphite and enclosing a longitudinally oriented open-ended casting cavity that is formed therebetween, such segments each having body side portions including respective generally flat inner surfaces on either side of said cavity in direct face-to-face contact with each other, and in part defining a continuous uninterrupted wall of said cavity. The graphite die of the subject invention further includes retaining means for maintaining the relative positioning of said segments during the heating of such die, said retaining means including a plurality of bolt/bushing sets, wherein the bolt head is positioned in one segment and the shaft thereof is fixed in the other segment. The bushings of such sets are constructed of a material having a higher coefficient of heat expansion than the material from which the bolts are formed, such that when the bushing is interposed between the bolt head and a wall portion of that die segment in which the bolt is received, its relatively greater expansion during die heating will subject the bolts to tension, thus progressively applying a greater force against the die segments to draw them into engagement with each other and thus assure the maintenance of the cavity configuration during use.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
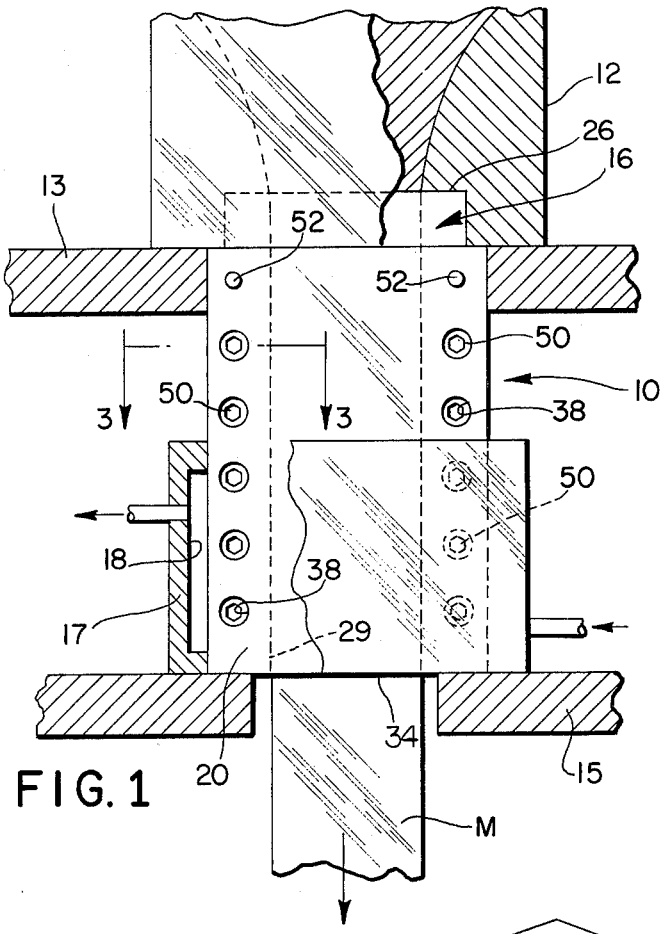
FIG. 1 is an overall view in somewhat schematic form of the end of a casting machine that receives a casting die constructed in the manner of the present invention.

Referring now to the drawing and particularly to FIG. 1 thereof, a casting die constructed in accordance with the present invention is generally indicated at 10 and is shown in operative association with the head 12 of a casting machine as by a support 13, wherein a metal M in molten form, especially a precious metal such as gold, silver and the like, is introduced into the entrance of a cavity generally indicated at 14 for subsequent cooling and solidification therein. Cooling is normally provided at the bottom end of the die 10 by means of a copper jacket or sleeve 17 having a cooling chamber 18 through which water is circulated for direct contact with the outside lower portions of the die 10. As shown in FIG. 1, the sleeve 17 and the lower portions of the die 10 may be mounted on an additional support 15.

The die 10 is normally formed of a graphite material which has an extremely low coefficient of heat expansion and which is able to simultaneously withstand extremely high temperatures in the order of 2000° F. at the entrance end thereof, while the bottom end thereof is subjected to room temperatures. Consequently, the molten metal entering the die cavity 14 can be solidified within a die of relatively short height and emerge therefrom in the form of a continuous strip or bar which is thereafter cut into predetermined lengths for later processing as by rolling into gold leaf and the like. A reduced neck portion generally indicated at 16 is adapted to be received within the head 12 of the casting machine and the die 10, whereas the cooling jacket or sleeve 17 having the cooling chamber 18 is positioned with respect thereto by any known means.

The metal passing through the die 10 upon solidification shrinks somewhat, i.e., in order to produce a gold bar of 0.375 inch actual thickness the die requires a cavity having a thickness of approximately 0.385 inches. In this connection it is particularly important that the internal surfaces of the cavity 14 be smooth and continuous, i.e., exhibit no undercut areas, so that the molten metal will not enter an undercut and solidify therein. It is seen that this could cause the continuously moving metal stock to become hung up in the die, and will either interrupt the casting procedure thereby necessitating that such be moved to an alternate die or shut down, or will cause destruction of the cavity surface. In this regard it is particularly important in two-piece segmented die constructions that the two segments be maintained in face-to-face relationship, so that the line separating the two faces and consequently forming a portion of the internal cavity 14, is not permitted to separate or open up. Such undesirable die segment separation would enable molten metal to move into the opening and form a flashing and since such flashing would constitute an undercut portion, shut down of the casting could result.

Figure 3:
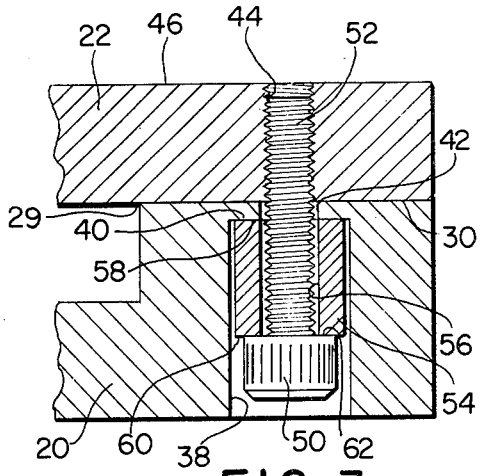
FIG. 3 is a cross-sectional view taken through line 3—3 of FIG. 1 showing a preferred construction of the means for maintaining the die segments in face-to-face relationship during use.
Figure 2:
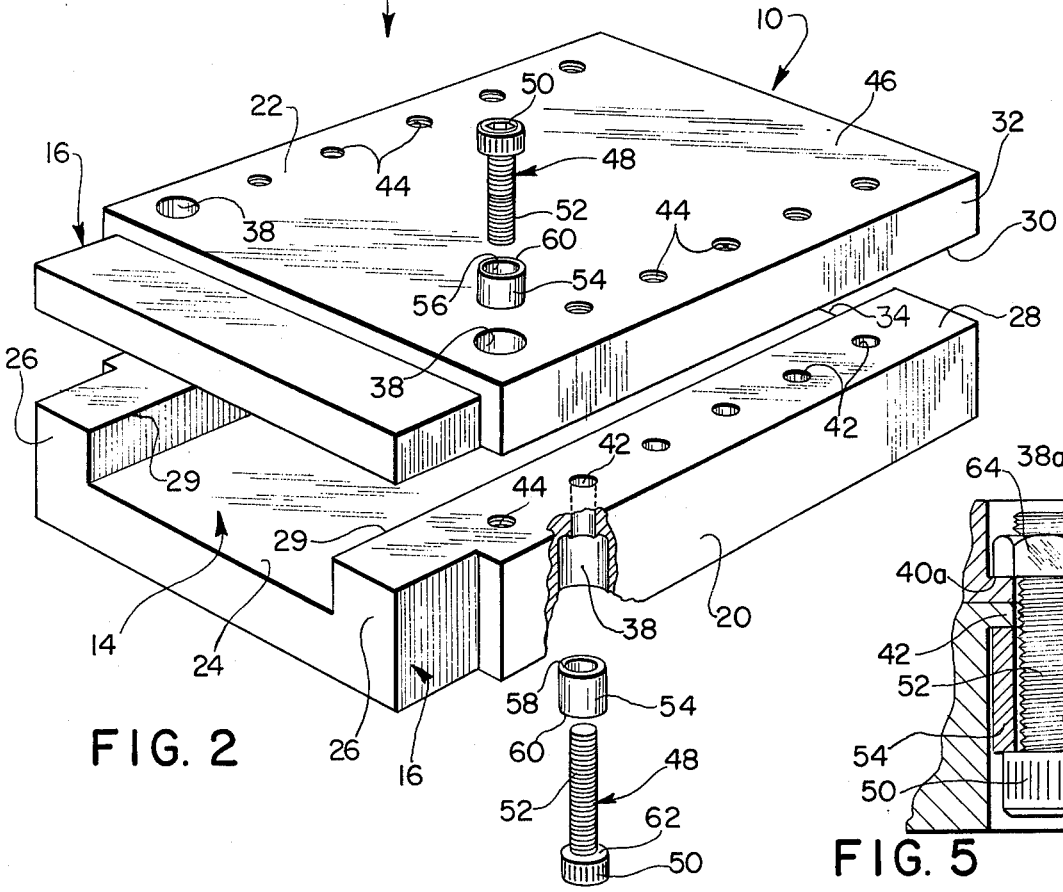
FIG. 2 is an exploded perspective view depicting the two die segments of the casting die embodied in the present invention.

Referring now to FIGS. 2 and 3, the novel manner in which the present segmented die construction is maintained together so as to overcome the above indicated prior art disadvantages is illustrated, and as shown the die construction 10 includes a lower die segment 20 and an upper die segment 22. Both die segments 20 and 22 are generally rectangular in cross-sectional configuration with the lower segment 20 being of somewhat greater thickness so as to accommodate the formation of the cavity 14 therein as by straightforward machining techniques, such as milling to form an open-ended slot 24 therein. The body side portions of the lower segment 20 on either side of such slot are designated by the reference numeral 26 and include a generally flat face 28 adapted, in turn, for face-to-face intimate engagement with a similarly configured face 30 provided on the body side portions 32 of the upper segment 22, and in this way serve to enclose the slot 24 and thus form the cavity 14. Alternatively, slots of lesser depth may be formed in each of the segments 20,22 and thus cooperatively serve to form the ultimate depth or thickness of the cavity 14. In either case the cooperation of faces 28,30 forms a parting or cavity line 29 along at least two opposed preferably smooth internal surfaces, in part forming the casting cavity 14. The cavity 14 maintains the same cross-sectional configuration from the reduced neck portion 16 to the exit end 34 of the die, and of course is open at both ends thereof so as to simultaneously receive molten metal at the reduced neck end 16 thereof and permit the withdrawal of the solidified metal stock from the lower end thereof.

Formed in the body side wall portions 26 are a series of longitudinally oriented spaced recesses 38 which, as shown in FIG. 3, project inwardly into the segment 20 a distance somewhat less than the full thickness thereof, and accordingly terminate in a bottom wall 40. The bottom wall, in turn, is provided with a bore 42 of smooth wall configuration which is adapted to project into a bore extension 44 extending through the upper segment 22 and aligned with the bore 42 of the mating lower die segment 20. The bore extensions 44 are threaded and extend outwardly from the inner face 30 to an outer surface 46. Such bore extensions 44 conveniently pass entirely through the thickness of the segment 22 at that location, but need not necessarily do so.

Each of the recesses 38 are adapted to receive tension means comprising a bolt generally indicated at 48 having an enlarged head 50 and a threaded shaft 52. Prior to the receipt of the bolts 48 within such cavities, expansion means comprising a bushing 54 having a smooth bore 56 is positioned therein so that a forward end 58 thereof is adapted to abut the bottom wall 40 of the recess 38, the rear edge 60 thereof contacting the forward face 62 of the bolt head 50. Each of the bolts 50 is thus tightly engaged in its bore extension 44 and all of the bolts 50 accordingly serve to initially maintain the die segments 20,22 in face-to-face relationship with respect to each other.

Normally upon exposing the bolts 48 to high temperature they would expand, and in effect, because of their fixed position with respect to the upper segment 22, they would force the segment 22 away from the lower segment 20 and would thus cause an opening to occur along the cavity lines 29. This action would enable molten metal to flow into such openings and upon solidification would cause a hang up in the die. However, in the present invention the bushings 54 are formed of a material that is different from that of the bolts 48 and which has a higher coefficient of heat expansion relative thereto. For example, the bolts 48 are normally formed of machine steel and the bushings 54 of copper or copper base alloys, and thus when the die 10 during the casting procedure is subjected to elevated temperatures, the bushings 54 will longitudinally expand at a greater rate than the bolts, thus placing the bolts under tension. Because of the bolts fixed position with regard to the upper segment 22, they will tend to draw the upper segment 22 against the lower segment 20. It should be clear that such force is progressively greater as the temperature of the casting die is elevated. Other suitable materials for the bolt/bushing sets are a titanium bolt in combination with a steel bushing, and tungsten bolts in combination with titanium bushings. The latter combination are representative of those materials which may be subjected to extremely high temperatures without distortion and thus may be reused in subsequent die applications. Normally graphite dies of this type are only used once in continuous long term runs and thereafter discarded since the configuration of the die cavity 14 may be altered as by frictional erosion.

Figure 4:
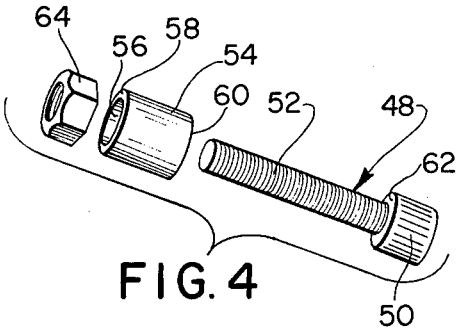
FIG. 4 is a perspective view showing an alternate bolt/bushing set.
Figure 5:
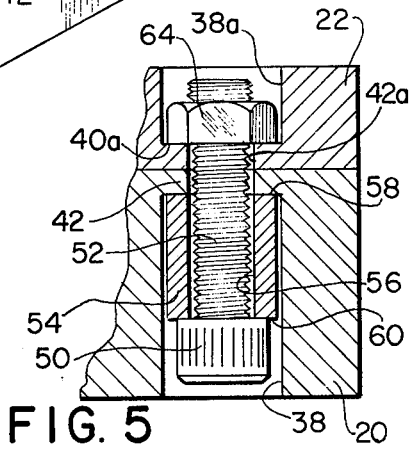
FIG. 5 is a cross-sectional view similar to FIG. 3, but showing an alternate die construction for maintaining the die segments together during use.

Referring now to FIGS. 4 and 5 of the drawing, an alternate manner of maintaining the die segments 20 and 22 together during elevated temperature use is shown. In this alternate form the upper cavity 22, instead of being provided with a series of bore extensions 44, is formed with a recess 38*a* similar to the recess 38 of die segment 20, and is further formed with a lower wall 40*a* and a smooth bore 42*a* of lesser diameter. The recesses 38, 38*a* and the bores 42, 42*a* are each adapted for mutual alignment and receipt of an alternate bolt/bushing set, it being clear that the threaded end of the alternate bolt shaft will extend upwardly into the recess 38*a* of the segment 22 for receipt of a threaded nut member 64. A second or lock nut (not shown) may also be utilized in conjunction with the nut member 64. In this manner, then, the bolts are fixed with respect to both the segments 20 and 22, and thus upon heat expansion, the bushings 54 will subject the bolts 48 to tension forces, thereby enabling the bolts to continually and progressively draw the upper and lower segments 20,22 together so as to assure the continuity of the mold cavity parting lines 29 and the maintenance of the opposed faces 28,30 in contact with each other.

In some cases it may be desirable to group the series of recesses 38 more closely together. Thus such recesses 38 may be grouped more closely in central portions of the die where the forces of the metal moving therethrough tend to be greatest, i.e., where freezing or solidification of the metal initially is believed to take place. Also more even distribution of the bolt forces may be achieved under some conditions by inwardly disposing alternate bolts in opposite directions, i.e., one bolt, extending inwardly from surface 36 while the next bolt extends from the opposite surface 46 and so on.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A casting die comprising separate upper and lower opposed die segments formed of a material having high temperature resistance and a low coefficient of heat expansion and enclosing a longitudinally orientated open ended casting cavity therebetween, said segments each having body side portions including respective generally flat inner surfaces outwardly disposed to either side of said cavity and in direct face-to-face contact with each other and in part defining a continuous uninterrupted wall of said cavity, and retaining means for maintaining the relative positioning of said segments with respect to each other so as to prevent separation of said surfaces from each other along said cavity wall during the heating of said die, said retaining means including a plurality of inwardly directed openings and headed bolts, each of said openings being longitudinally oriented along the side portions of one of said die segments and having a reduced bore portion formed therein, each of said headed bolts being received in a reduced bore portion and passing through said one die segment and into fixed engagement with the respective body side portion of the other of said segments, a hollow bushing receiving said bolt disposed within each such opening and contacting the opening bottom at one end thereof and the bolt head at the other end thereof, said bushing having a higher coefficient of thermal expansion than said bolt so that upon heating of the die the bushings will expand relatively greater than said bolts thereby progressively tensioning said bolts so as to maintain said die segments in engagement with each other .

2. The die construction of claim 1, said bore having an aligned threaded continuation passing into said other die segment, said bolts having a threaded shaft threaded directly into said other die segment body side portions.

3. The die construction of claim 1, said other die segment body side portions also having a plurality of inwardly directed openings aligned with said one body side portion openings and including a reduced bore, said bolts having a threaded shaft passing through said bores from one opening into the other, and nut means in said other opening for receiving said threaded shaft.

4. The die construction of claim 1, said die segments being formed of graphite.

5. The die construction of claim 4, said casting cavity having a rectangular cross-sectional configuration and formed by a slot having an open top and machined entirely within one of said die segments.

6. The die contruction of claim 4, wherein said bolts are steel and said bushings are a copper base material.

7. The die construction of claim 4, wherein said bolts are titanium and said bushings are steel.

8. The die construction of claim 1, said bolts being alternatively inwardly directed from opposite body side portions of said die segments.

9. The die construction of claim 1, said die having an upper end including a reduced neck that is received in a casting machine or the like wherein the temperature within said die is highest at said upper end and progressively cooler towards the bottom end, the bolt bushing retaining means located at said upper end being formed of materials having lower expansion coefficients than the retaining means that are located at progressively cooler die portions.

10. A casting die comprising separate upper and lower opposed die segments formed of a material having high temperature resistance and a low coefficient of heat expansion and enclosing a longitudinally oriented open ended cavity therebetween, said segments each having body side portions including respective generally flat innner surfaces outwardly disposed to either side of said cavity and in direct face-to-face contact with each other and in part defining a continuous uninterrupted wall of said cavity, and retaining means for maintaining the relative positioning of said segments with respect to each other so as to prevent separation of said surfaces from each other along said cavity wall during the heating of said die, said retaining means including tension means fixedly engaged with one of said segments to force said one segment into interengagement with the other segment, expansion means operatively associated with said tensioning means and said other segment, said expansion means having a higher coefficient of thermal expansion than said tension means so that upon heating of the die the expansion means will expand relatively greater than said tension means thereby progressively increasing the force applied by said tension means to said segments so as to maintain said die segments in engagement with each other.

11. The die construction of claim 10, wherein said tension means and said expansion means respectively comprise a plurality of bolt/bushing sets.

12. The die construction of claim 11, said bolts constructed from a material selected from the group consisting of steel, titanium and tungsten.

13. The die construction of claim 11, said bushings constructed from a material selected from the group consisting of copper, steel and titanium.

* * * * *